United States Patent [19]

Takata

[11] Patent Number: 4,840,052

[45] Date of Patent: Jun. 20, 1989

[54] MOBILE NOZZLE DEVICE FOR DIE LUBRICATING

[75] Inventor: Yasuhira Takata, Niihama, Japan

[73] Assignee: Sumitomo Heavy Industries, Ltd., Tokyo, Japan

[21] Appl. No.: 287,961

[22] Filed: Dec. 21, 1988

[30] Foreign Application Priority Data

Dec. 30, 1987 [JP] Japan ..... 62-200823[U]

[51] Int. Cl.[4] ..... B21C 9/00

[52] U.S. Cl. ..... 72/45

[58] Field of Search ..... 72/39, 41, 43, 44, 45; 134/143; 164/72, 158, 267

[56] References Cited

U.S. PATENT DOCUMENTS

| | | | |
|---|---|---|---|
| 3,633,651 | 1/1972 | Ruhlandt | 164/267 |
| 3,941,537 | 3/1976 | Abraham | 164/158 X |
| 4,284,670 | 8/1981 | Kole | 72/43 X |
| 4,520,643 | 6/1985 | Werner et al. | 72/45 X |

FOREIGN PATENT DOCUMENTS

| | | | |
|---|---|---|---|
| 3039914 | 5/1982 | Fed. Rep. of Germany | 72/43 |
| 219535 | 6/1968 | U.S.S.R. | 72/45 |
| 436695 | 7/1974 | U.S.S.R. | 72/45 |
| 632879 | 11/1978 | U.S.S.R. | 72/45 |
| 1214299 | 2/1986 | U.S.S.R. | 72/43 |
| 749010 | 5/1956 | United Kingdom | 72/45 |

*Primary Examiner*—E. Michael Combs

*Attorney, Agent, or Firm*—Armstrong, Nikaido, Marmelstein, Kubovcik & Murray

[57] ABSTRACT

A mobile nozzle device for spraying a lubricant to the surfaces of dies of a forging press in separated state. The device has a lever which is pivotally connected at its upper end to the frame of the forging press and connected at its intermediate portion to the press slider through a link such that it swings about the upper end pivot in accordance with the reciprocal movement of the press slider. The device further has a mobile nozzle secured to an end of a horizontal bar which is movable horizontally and reciprocally in engagement with the lower end of the lever, so that the mobile nozzle is movable into and out of the press in accordance with the vertical stroking of the press slider. This nozzle device can operate without fail in a timed relation to the operation of the press slider. In addition, a high-speed operation is realized by virtue of the long lever so that the nozzle can stay for a longer time in the space between the dies of the press in separated state, thus ensuring an effective spray of the lubricant.

6 Claims, 7 Drawing Sheets

MOBILE NOZZLE DEVICE FOR DIE LUBRICATING

BACKGROUND OF THE INVENTION

1. Field of the Invention

The present invention relates to a mobile nozzle device for spraying a lubricant to the surface of dies in a forging press. More particularly, the invention is concerned with a mobile nozzle device capable of operating in a timed relation to the operation of a press slider so as to move a lubricant nozzle into and out of a space between upper and lower dies.

2. Description of the Prior Art

It is well known to spray a mixture fluid consisting of a lubricant and compressed air onto the surfaces of dies in, for example, a forging press in advance of placement of a material for the purpose of enabling an easy parting of the forged article from the press, as well as for cooling and cleaning of the dies. A typical mobile nozzle device used for this purpose employs a plurality of lubricant nozzles provided on one side of a lubricant supply pipe. These nozzles are adapted to be moved into and out of the space between upper and lower dies so as to spray a mixture fluid containing a lubricant onto the surfaces of a plurality of dies at a time.

A typical conventional device for moving the lubricant nozzles into and out of the space between upper and lower dies employs a truck which carries a lubricant pipe provided at its end with the lubricant nozzles and which is movable back and forth into and out of the space by a pneumatic or a hydraulic actuator. Alternatively, the lubricant pipe is connected to the drive shaft of a transfer feeder through a cam mechanism so that the pipe is moved into and out of the space by the power of the drive shaft of the transfer feeder.

The conventional devices which employs the truck movable by the power of a pneumatic or hydraulic actuator or the cam mechanism driven by the power of the drive shaft of the transfer feeder essentially requires a long operation time of 1.5 to 2 seconds for the nozzles to complete one operation cycle, i.e., one reciprocating motion including forward stroke and a backward stroke to get into and out of the space between the dies. In recent years, the operation speed of presses is increasing to meet the demand for higher production efficiency so that the nozzles can stay in the space between the separated upper and lower dies only for such a short time that lubricant cannot be supplied in an amount large enough to achieve the expected effects.

In another conventional device of the type in which the lubricant nozzle means is thrust upon a slide to move following the latter, as shown for example, in U.S. States Pat. No. 4,520,643, high speed operation of the press tends to put the nozzle means out of the slide so that the nozzle means cannot follow the movement of the slide. Accordingly the acceleration of the nozzle means is limited below such a level that the nozzle means can positively follow. This results in preventing the high speed operation of the forging press. It is to be noted that it is desirable for a hot forging press to shorten the forging time for preventing wear of the dies. Increased operation speed of presses also causes problems such a mis-timing of the nozzle operation in relation to the timing of operation of the dies which is increased during repeated operation of the press or impossibility of use of conventional nozzle due to mismatching of operation timing of the nozzles and the press.

SUMMARY OF THE INVENTION

Accordingly, an object of the present invention is to provide a mobile nozzle device for spraying a lubricant to the surfaces of dies, which is capable of operating steadily in a timed relation to the operation of the press slider and which has operation speed which is so high that the nozzles are allowed to stay in the spray space for a time which is long enough to spray a sufficiently large amount of lubricant.

To this end, according to the present invention, there is provided a mobile nozzle device for spraying a lubricant to surfaces of dies of a forging press in a separated state, comprising: lever means pivotally connected at its upper end to a frame of the forging press through a pivot shaft, the lever means being connected at its intermediate portion to a press slider of the forging press such as to swing about the pivot shaft in relation to the vertical stroking of the slider; a guide member secured to the lower end of the lever means and having a guide portion extending in the longitudinal direction of the lever means; a horizontal bar member horizontally movably carried by a truck and carrying a roller engaging with the guide portion of the guide member; and a mobile nozzle held by the end of the horizontal bar member; whereby the horizontal bar member is moved horizontally to get said mobile nozzle into and out of the space between the dies of the forging press with the roller engaging the guide portion of the guide member in response to vertical stroking of the press slider.

Preferably, the lever means includes a first lever member pivotally connected to the frame of the forging press, a second lever member pivotally connected to the lower end of the first lever, and means for holding the first and second lever members in a straightened condition when the level of the rotational torque applied to the second lever member is below a predetermined level. The movable nozzle device is pivotally secured to one end of the horizontal bar member and is constructed such that it is held in horizontal position unless a torque exceeding a predetermined torque value is applied thereto. According to this arrangement, the lever members constituting the lever means, horizontal bar member and the movable bar are held safely even if an unexpected external force is applied.

The above and other objects, features and advantages of the present invention will become clear from the following description of the preferred embodiments when the same is read in conjunction with the accompanying drawings.

DESCRIPTION OF THE PREFERRED EMBODIMENTS

Figure 1:
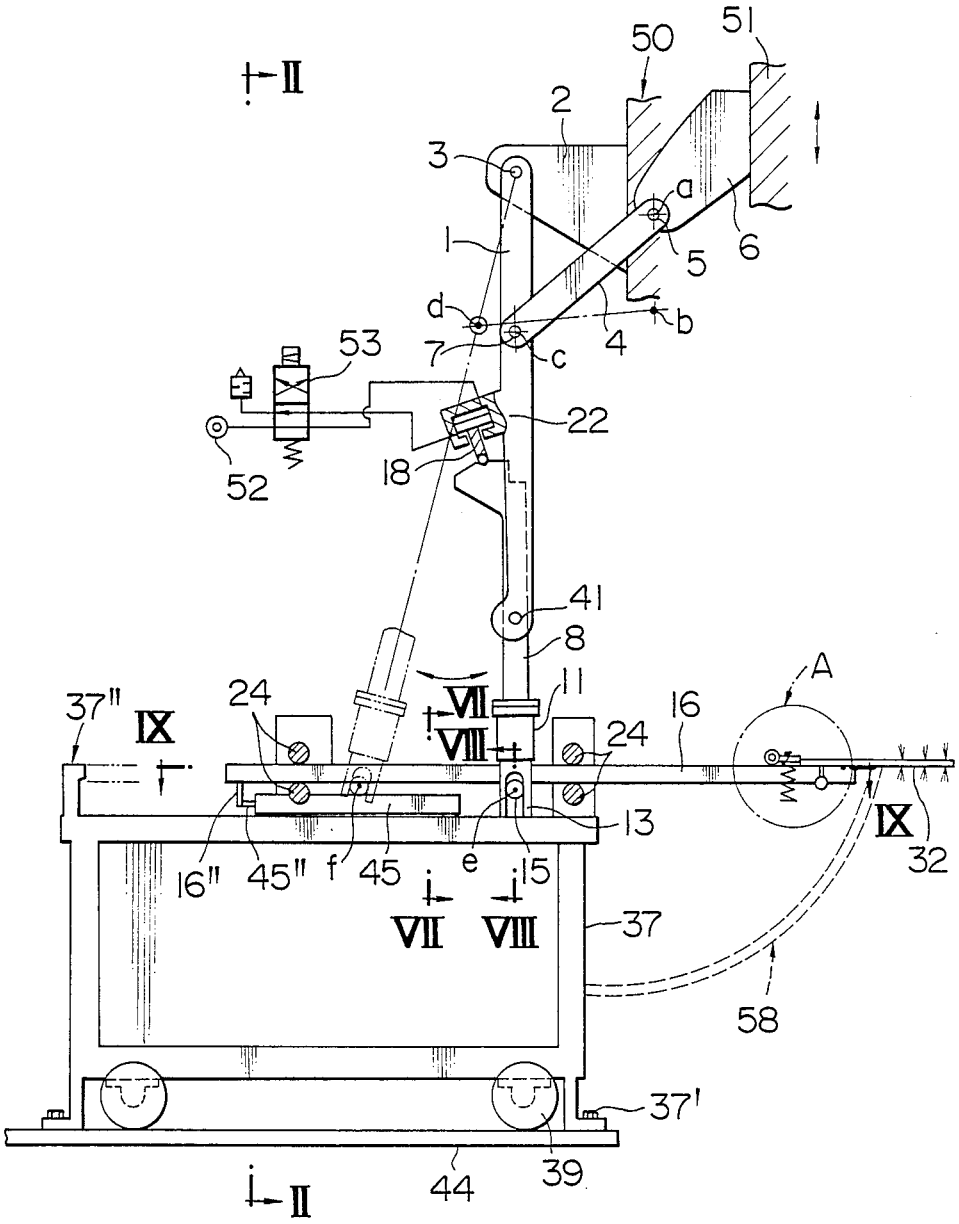
FIG. 1 is a side elevational view of a preferred embodiment of the mobile nozzle device in accordance with the present invention.
Figure 2:
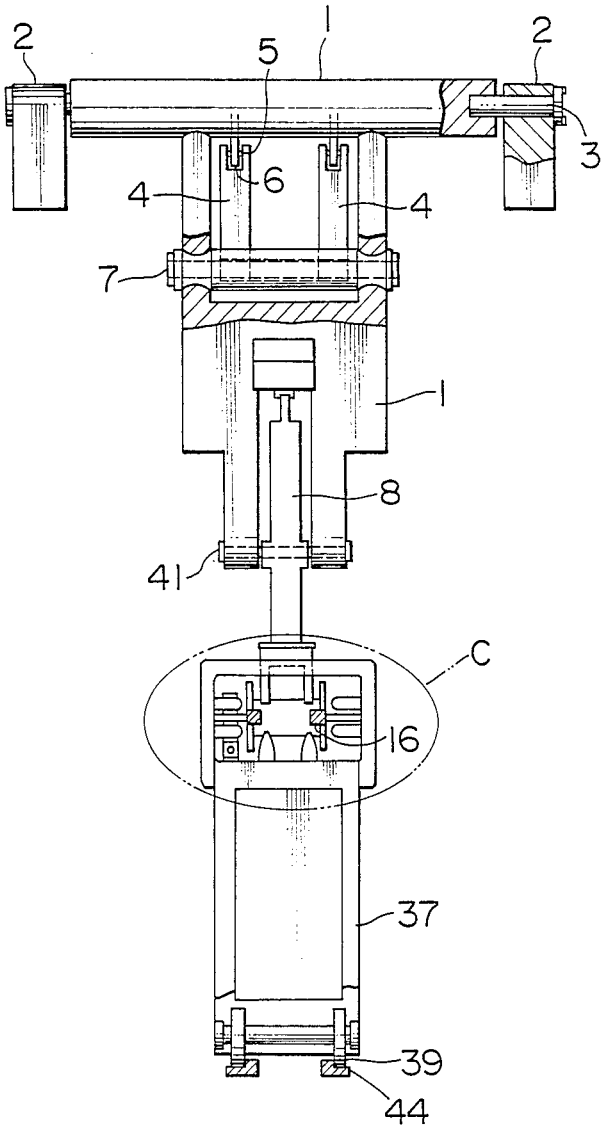
FIG. 2 is a sectional front elevational view of the mobile nozzle device taken along the line II—II of FIG. 1.

FIG. 1 is a side elevational view of a preferred embodiment of the mobile nozzle device in accordance with the present invention, while FIG. 2 is a sectional front elevational view taken along the line II—II of FIG. 1.

The device has a first lever member 1 which has a generally T-shaped form as illustrated in FIG. 2. Both ends of a horizontal beam-like portion of the T-shaped lever 1 are pivotally secured to brackets 2 fixed to a frame 50 of a forging press by means of pivot pins 3. The first lever 1 is pivotally connected at its intermediate portion near the top end thereof to a link 4 by means of a pivot pin 7. The upper end of the link 4 is connected to a bracket 6 fixed to the press slider 51 by means of a pivot pin 5. The lower end of the first lever 1 is forked as shown in FIG. 2 and a second lever 8 is fitted in this forked portion. The second lever 8 is pivotally connected at its intermediate portion to the lower end of the first lever 1 through a pivot pin 41.

Figure 4:
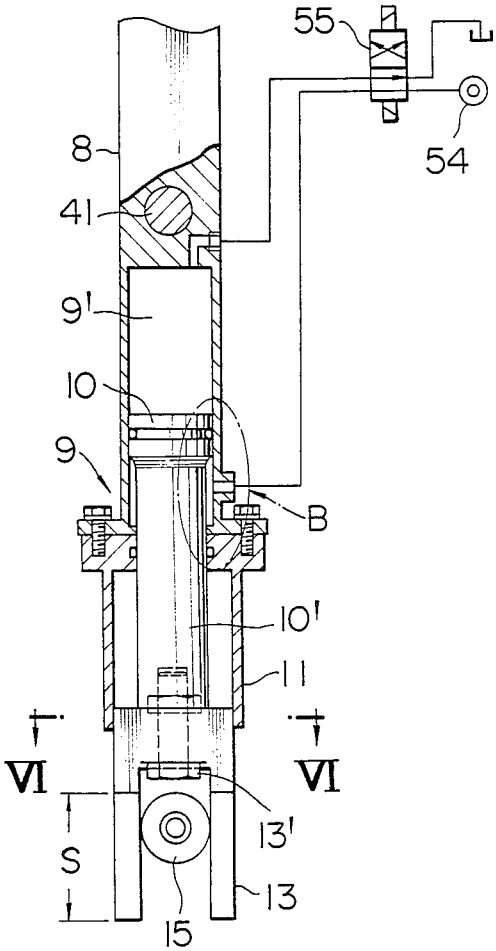
FIG. 4 is an enlarged section view of a cylinder device provided on a second lever member and a fork end secured to the end of a piston rod of the cylinder device.
Figure 3:
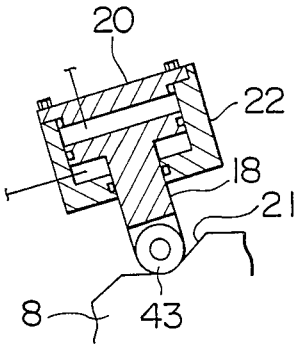
FIG. 3 is an enlarged sectional view of a cylinder provided on a first lever member.
Figure 5:
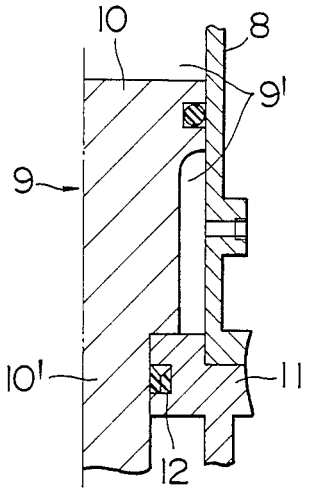
FIG. 5 is an enlarged sectional view of a portion marked at B in FIG. 4.
Figure 6:
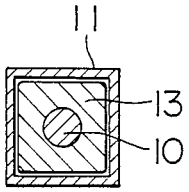
FIG. 6 is a sectional plan view taken along the line IV—IV of FIG. 4.

Referring now to FIG. 3 which is an enlarged sectional view of the upper end portion of the second lever and a cylinder portion engaging therewith, while FIG. 4 is an enlarged sectional view of a fork end guide portion provided by the lower end of the second lever 8. FIG. 5 is an enlarged sectional view of the portion marked at B in FIG. 4. Referring to FIGS. 1 and 3, the upper end of the second lever 8 has a generally sector-shaped form when viewed in side elevation, and a V-shaped groove is formed in the upper edge of the upper end of the second lever. The V-shaped groove receives a roller 43 which is carried by an end of a piston rod 18 of the cylinder portion 22 of the first lever 1.

The piston and the piston rod 18 are sealingly received in the cylinder portion 22 with sealing "O" rings interposed therebetween. The cylinder portion 22 is closed by an end plate 20 so as to form a closed chamber into which a fluid pressure is introduced from a pneumatic pressure source through a pneumatic valve 53. As will be explained later, the lower end of the second lever 8 engages with a roller 15 connected to a horizontal bar 16 through a fork member (fork end) 13.

As will be clearly understood from FIGS. 4 and 5, a cylinder device 9 is incorporated in the second lever 8. The cylinder device 9 includes a cylinder chamber 9', a piston 10 received in the cylinder chamber 9' and having a piston rod portion 10', and a substantially square tubular fork end guide 11 connected to the lower end of the cylinder chamber and serving also as a cover for covering the piston rod portion 10'. An "O" ring is interposed between the piston 10 and the second lever 8, while a Y-shaped packing 12 is disposed between the piston rod portion 10' and the fork end guide 11, so as to provide seals in the gaps between these members. The cylinder chamber 9' is adapted to be supplied with a fluid pressure from a pneumatic pressure source 54 through a valve 55. The fork end 13 is forked at its lower end with its upper end fixed to the lower end of the piston rod portion 10' by means of bolts 13' so as to be able to move into and out of the space inside the fork end guide 11.

Figure 7:
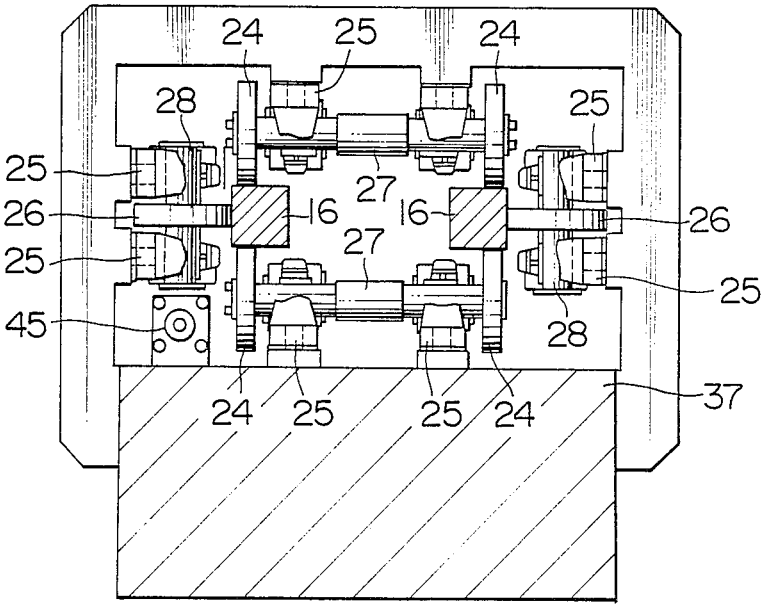
FIG. 7 is an enlarged sectional front elevational view of the portion marked at C in FIG. 1 taken along the line VII—VII of FIG. 1.
Figure 8:
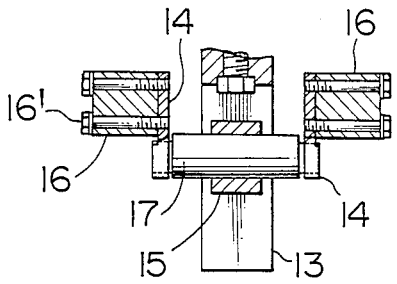
FIG. 8 is an enlarged sectional view taken along the line VIII—VIII of FIG. 1.
Figure 9:
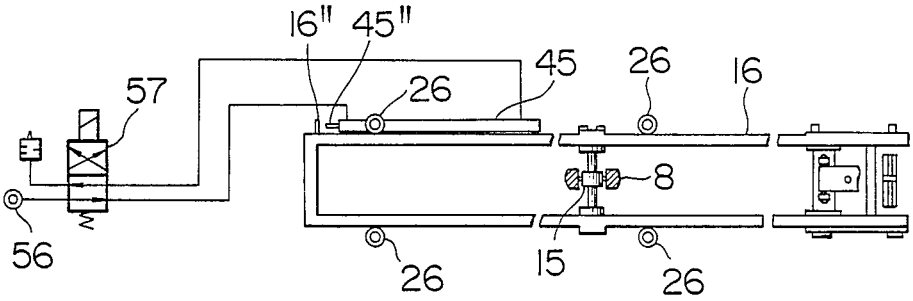
FIG. 9 is an enlarged sectional plan view taken along the line IX—IX of FIG. 1.

FIG. 7 is an enlarged sectional front elevational view taken along the line VII—VII of FIG. 1, illustrating particularly the horizontal bar 16 and a mechanism for guiding the movement of the horizontal bar 16. FIG. 8 is an enlarged sectional view taken along the line VIII—VIII of FIG. 1, while FIG. 9 is an enlarged fragmentary sectional plan view taken along the line IX—IX of FIG. 1. The truck 37 carries an elongated horizontal bar 16 having a substantially U-shaped planar shape. The horizontal bar 16 is carried by the truck 37 such as to be movable horizontally towards and away from the dies of the forging press while being guided by guide rollers 24, 26 at its upper and lower sides and left and right sides. As will be seen from FIG. 7, the guide roller 24 is fixed to a shaft 27, while a guide roller 26 is fixed to a shaft 28. These shafts 27 and 28 are supported by a bearing unit 25 which is fixed to the frame of the truck 37.

Referring to FIGS. 4, 8 and 9, a second lever 8 is received in the frame of the horizontal bar 16. Brackets 14 are fixed to the inner surfaces of the horizontal bar 16 by means of bolts 16' such as to extend downward. The brackets 14 support a pin 17 which rotatably supports a roller 15. The roller 15 is received in the forked portion of the fork end 13 so as to be movable horizontally together with the horizontal bar 16 while being guided by the fork end.

Figure 10:
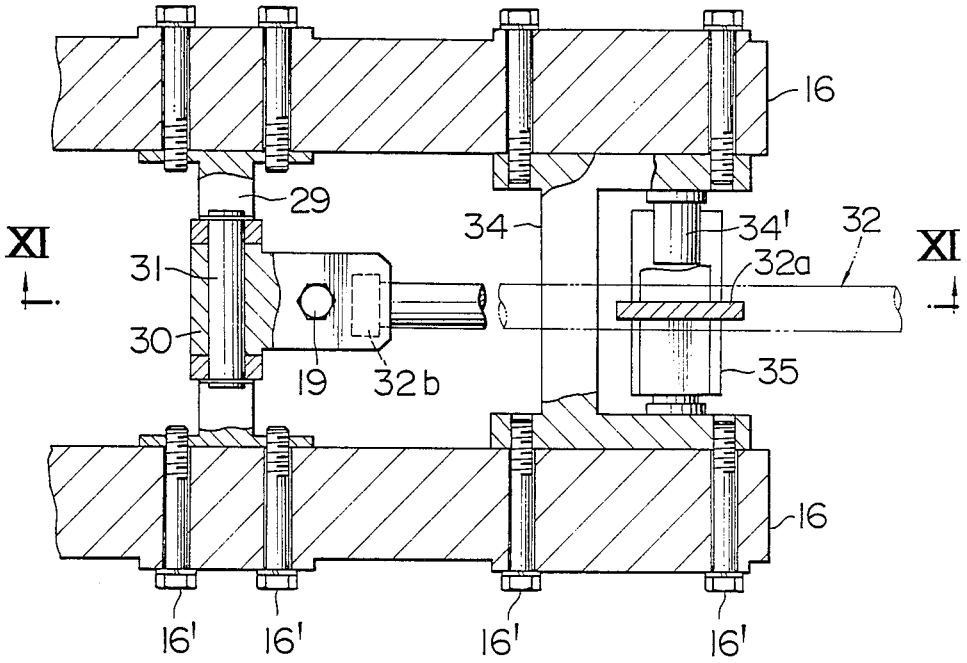
FIG. 10 is an enlarged plan view of the portion marked at A in FIG. 1.
Figure 11:
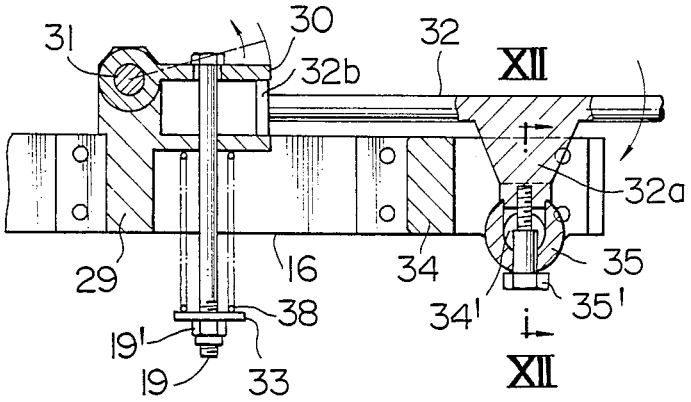
FIG. 11 is a sectional view taken along the line XI—XI of FIG. 10.
Figure 12:
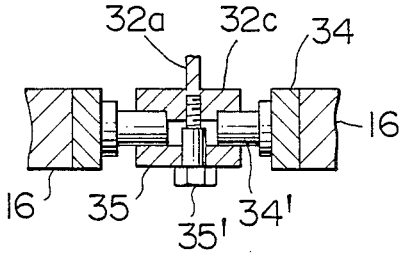
FIG. 12 is a sectional front elevational view taken along the line XII—XII of FIG. 11.

FIG. 10 is an enlarged plan view of the portion marked at A in FIG. 1, i.e., the connection between the horizontal bar 16 and the mobile nozzle 32. FIG. 11 is a sectional side elevational view of the arrangement shown in FIG. 10 taken along the line XI—XI of FIG. 10. Brackets 34 and 29 are fastened by, for example, bolts to the end of the horizontal bar 16 adjacent to the forging press. One 34 of these brackets carries a pair of pins 34' which oppose each other. A substantially crescent-shaped support bracket 35 is fitted to the pins 34' from the lower side thereof. A seat 32*c* attached through a bracket 32*a* to the lower portion of the nozzle 32 is placed on the pins 34' and, as shown in FIGS. 11 and 12, a bolt which has been inserted into a bolt hole in the support bracket 35 from the lower side is screwed to the seat 32*c* of the nozzle 32, whereby the nozzle is pivotally carried by the horizontal bar 16 by means of the pins 34'. The other bracket 29 carries a pressing plate 30 through the intermediary of a pivot pin 31. The rear end of the nozzle 32 has a T-shaped form as shown in FIG. 11. The T-shaped portion 32*b* of the nozzle 32 is clamped between the pressing plate 30 and the bracket 29. The pressing plate 30 is downwardly urged through a bolt 19 by means of an urging mechanism which includes, in addition to the bolt 19, a spring 38, a spring seat 33 and a nut 19' which engages with the bolt 19. As will be seen from the drawings, the spring 38 is loaded between the racket 29 and the spring seat 33 provided on the end of the bolt.

Referring now to FIGS. 1 and 2, a truck 37 has wheels 39 capable of rolling on rails 44, so that the truck 37 is movable along the rails 44. The truck 37 is fixed to a base by means of bolts 37′ and is held in this state during ordinary operation of the device. As will be seen from FIGS. 1 and 9, a cylinder device 45 is provided on the truck 37 at a position in the vicinity of the horizontal bar 16. The cylinder device 45 has a piston rod 45″ the end of which is capable of abutting an end projection 16″ of the horizontal bar 16.

The cylinder device 45 is adapted to be supplied with a fluid pressure from a pneumatic pressure source 56 through a valve 57.

The operation of the mobile nozzle device will be described in relation to the operation of a forging press with which the mobile nozzle device is associated.

As the press slider 51 is lowered, the point a on the link 4 is lowered to a position or point b through the movement of the bracket 6 while the point c at which the other end of the link 4 is connected to the first lever 1 is moved to a position or point d. In consequence, the first lever 1, second lever 8 and the fork end 13 are swung to positions shown by broken lines in FIG. 1 around the pivot pin 3. Meanwhile, the swinging of the forked portion of the fork end 13 causes, through the action of the roller 15, the horizontal lever 16 to be moved apart from the forging press, whereby the center of the roller 15, i.e., the point e, is moved to a position or point f, thus causing the nozzle 32 to move out of the mold. A reverse sequence is executed during upward stroking of the press slide 52, so that the nozzle 32 is moved into the space between the upper and lower dies which have been separated from each other, so that the nozzle sprays a lubricant from the hose 58 to the surfaces of the upper and lower dies. Thus, the horizontal bar 26 and the nozzle 32 are moved to the left and right in relation to the vertical stroking of the press slide, thereby performing one cycle of operation during one reciprocal stroking of the press slider 51.

In the mobile nozzle device of the present invention, the nozzle 32 is operatively connected to the slide 51 through the link mechanism. Accordingly when the forging press is operated intermittently at high speed, the acceleration of the nozzle 32 is not limited so that the nozzle 32 is quickly moved. That is, during one cycle, the time required for getting the nozzle 32 into and out of the space between the dies is decreased and thus the time required for spraying the lubricant is increased to improve the dies lubrication time and the dies cooling time so as to enable the forging press to be operated at high speed.

In the event that an external force is applied to the nozzle 32 for any reason such as to act to restrict the left and right movement of the horizontal bar 16, the fork end 13 is overloaded through the bracket 14, roller 15 and the shaft 17. In such a state, a torque is applied to the second lever 8 tending to rotate this lever 8 about the pivot pin 41. This torque overcomes the tangential force acting between the roller 43 under the force of the piston rod 18 and the V-shaped groove 21 in the upper end of the second lever 8, so that the piston rod 18 is disengaged and freed from the V-shaped groove 21 thereby freeing the lever 8. This arrangement effectively protects the levers 1 and 8 against any breaking external force.

If the nozzle 32 is overloaded for an external reason by a force acting downward as viewed in FIG. 1 or 11, a torque is applied to nozzle 32 tending to rotate the nozzle 32 about the pins 34′ (see FIGS. 10 and 12). This torque overcomes the force of the spring 38 which presses the pressing plate 30 so that the pressing plate 30 is lifted to disengage the T-shaped portion 32*b* of the nozzle 32 from the pressing plate 30. The downward overloading force, therefore, is not transmitted to the horizontal bar 16. According to the invention, therefore, a protecting function is realized to protect the horizontal bar 16 and the mobile nozzle 32 against vertical and lateral forces.

When the mobile nozzle device is not used, pressurized fluid is introduced into the cylinder from the lower side of the piston 10 so as to raise the piston 10. The fork end 13 is lifted by a stroke S (see FIG. 4) out of engagement with the roller 15. On the other hand, pneumatic pressure is introduced into the cylinder chamber of the cylinder device 45 adjacent to the forging press, so that the piston rod is projected. As a result, the end of the rod 45″ abuts the end projection 16″ of the horizontal bar 16 so as to urge the horizontal bar 16 to the left as viewed in FIG. 1, whereby the bar 16 is stopped by a stopper 37″ on the truck so as to hold the nozzle 32 away from the press.

When a maintenance work for the press is to be conducted, the mobile nozzle device is set in the inoperative state as described above and a pressure is introduced to the lower side of the piston rod 18 so as to free the second lever 8. Then, the bolts 37′ are removed to allow the truck 37 leftward to a position spaced from the press.

As has been described, the mobile nozzle device of the present invention can operate without fail in a timed relation to the operation of a forging press. In addition, a high operation speed is obtained by virtue of the long lever structure so as to afford a longer time of stay of the nozzle in the space between the dies so that the lubricant can sufficiently applied to the die surfaces. It is also to be noted that change-over between the operative and inoperative modes of the mobile nozzle device can be accomplished by a simple operation of the change-over valve. Furthermore, the size of the dead space required for connection between the nozzle device and the transfer feeder can be reduced by virtue of the linear operation of the nozzle device. Furthermore, the levers 1, 8, horizontal bar 16 and the mobile nozzle 32 are safely protected against any external breaking force.

What is claimed is:

1. A mobile nozzle device for spraying a lubricant onto surfaces of dies in a forging press when said press is in an open position and said dies are separated, comprising: lever means pivotally connected at an upper end thereof to a frame of said forging press through a pivot shaft, said lever means being connected at an intermediate portion thereof to a press slider of said forging press such as to swing about said pivot shaft in response to the vertical movement of said slider; a guide member secured to a lower end of said lever means and having a guide portion extending in the longitudinal direction of said lever means; a horizontal bar member horizontally movably carried by a truck and carrying a roller positioned for engagement with said guide portion of said guide member; and a mobile nozzle mounted on an end of said horizontal bar member; whereby said horizontal bar member is moved horizontally to position said mobile nozzle into and out of a space between the seperated dies of said forging press by the engagement of said roller with said guide portion of said guide member, in response to vertical movement of said press slider.

2. A mobile nozzle device according to claim 1, wherein said lever means includes a first lever member pivotally connected to said frame of said forging press, a second lever member connected to a lower end of said first lever member, and straightening means for holding said second lever in a straightened condition with respect to said first lever member when the torque applied to said second lever member is below a predetermined level.

3. A mobile nozzle device according to claim 2, wherein said second lever member is pivotally connected at an intermediate portion to said lower end of said first lever member and is provided at an upper end with a sector-shaped portion, and wherein said straightening means includes a V-shaped groove formed in the periphery of said sector-shaped portion and a cylinder secured to said first lever member and having a piston rod with an end with which engages with said V-shaped groove.

4. A mobile nozzle device according to claim 2, wherein said mobile nozzle is pivotally carried by the end of said horizontal bar, said mobile nozzle device further comprising means for holding said mobile nozzle in horizontal posture when the torque applied to said mobile nozzle is below a predetermined level.

5. A mobile nozzle device according to claim 1, wherein said guide member is a downwardly extending forked member rotatably receiving said roller.

6. A mobile nozzle device according to claim 5, wherein said forked member is secured to said lower end of the lever means for vertical movement relative to said lever means.

* * * * *